US010161027B2

(12) United States Patent
Harrison et al.

(10) Patent No.: US 10,161,027 B2
(45) Date of Patent: Dec. 25, 2018

(54) HEAT TREATMENT FOR REDUCING DISTORTION

(71) Applicant: Ford Motor Company, Dearborn, MI (US)

(72) Inventors: Nia R. Harrison, Ann Arbor, MI (US); Suranjeeta Dhar, Novi, MI (US); Patrice White-Johnson, West Bloomfield, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 330 days.

(21) Appl. No.: 14/822,379

(22) Filed: Aug. 10, 2015

(65) Prior Publication Data

US 2017/0044650 A1 Feb. 16, 2017

(51) Int. Cl.

| | |
|---|---|
| ***C22F 1/05*** | (2006.01) |
| ***C22F 1/057*** | (2006.01) |
| ***C22F 1/047*** | (2006.01) |
| ***C22F 1/043*** | (2006.01) |
| ***C22F 1/00*** | (2006.01) |
| ***C22C 21/02*** | (2006.01) |
| ***C22C 21/08*** | (2006.01) |
| ***C22C 21/14*** | (2006.01) |
| ***C22C 21/16*** | (2006.01) |
| ***C22C 21/18*** | (2006.01) |

(52) U.S. Cl.

CPC ..... *C22F 1/057* (2013.01); *C22C 21/02* (2013.01); *C22C 21/08* (2013.01); *C22C 21/14* (2013.01); *C22C 21/16* (2013.01); *C22C 21/18* (2013.01); *C22F 1/002* (2013.01); *C22F 1/043* (2013.01); *C22F 1/047* (2013.01); *C22F 1/05* (2013.01)

(58) Field of Classification Search

CPC ..... C22F 1/057; C22F 1/047; C22F 1/043; C22F 1/05

See application file for complete search history.

(56) References Cited

U.S. PATENT DOCUMENTS

| | | | | |
|---|---|---|---|---|
| 5,582,660 | A * | 12/1996 | Erickson et al. | 148/688 |
| 7,029,543 | B2 | 4/2006 | Bull et al. | |
| 7,666,267 | B2 | 2/2010 | Benedictus et al. | |
| 8,142,579 | B2 | 3/2012 | Koma | |
| 8,496,764 | B2 | 7/2013 | Luckey et al. | |
| 8,636,855 | B2 | 1/2014 | Wang et al. | |
| 8,721,811 | B2 | 5/2014 | Lin et al. | |
| 2002/0017344 | A1 | 2/2002 | Gupta et al. | |
| 2002/0121319 | A1* | 9/2002 | Chakrabarti et al. | 148/694 |
| 2004/0140026 | A1 | 7/2004 | Kamat et al. | |
| 2005/0211350 | A1 | 9/2005 | Unal et al. | |
| 2006/0000094 | A1 | 1/2006 | Garesche et al. | |
| 2012/0152416 | A1* | 6/2012 | Foster et al. | 148/695 |
| 2013/0228252 | A1 | 9/2013 | Smeyers et al. | |
| 2013/0319585 | A1* | 12/2013 | Parson et al. | 148/690 |

FOREIGN PATENT DOCUMENTS

| | | | |
|---|---|---|---|
| CN | 102134671 | A | 7/2011 |
| DE | 102011105447 | A1 | 12/2012 |
| KR | 101147952 | B1 | 5/2012 |

* cited by examiner

*Primary Examiner* — Edward M Johnson
(74) *Attorney, Agent, or Firm* — Marla Johnston; Brooks Kushman P.C.

(57) ABSTRACT

Methods of processing an aluminum alloy component are disclosed. The method may include solution heat treating the component at a solution heat treatment (SHT) temperature of 500° C. to 535° C., quenching the component in a liquid quenching medium having a temperature of 75° C. to 95° C., and artificially aging the component at an artificial aging (AA) temperature of 200° C. to 250° C. to a yield strength of at least 200 MPa. The component may be a 6XXX series aluminum alloy, which may be (or have been) progressively stamped. The component may be artificially aged to an r/t ratio of less than 0.3. The liquid quenching medium may be water and may have a temperature of 82° C. to 88° C. The method may further include joining the aluminum alloy component to a second component with a self-piercing rivet. The disclosed methods may reduce distortion in the component while maintaining high strength and bendability.

20 Claims, 9 Drawing Sheets

BASELINE - PRE-T7

| | CWY | HSZ | KTX | LTY | JTX | GWZ | AWY | IWY | FWY | BCS.TP |
|---|---|---|---|---|---|---|---|---|---|---|
| 1 | -0.5241 | 0.1848 | -0.0176 | -0.0957 | -0.0103 | -0.3078 | -0.2213 | -0.1358 | -0.1114 | 0.3820 |
| 2 | -0.5367 | 0.1528 | -0.0083 | -0.0195 | -0.0208 | -0.3086 | -0.2226 | -0.2110 | -0.2033 | 0.2829 |
| 3 | -0.5660 | 0.0793 | -0.0270 | -0.0409 | 0.0032 | -0.4125 | -0.2265 | -0.1629 | -0.1859 | 0.0630 |
| 4 | -0.5206 | 0.1600 | -0.0232 | -0.0842 | -0.0100 | -0.3665 | -0.2277 | -0.1582 | -0.1334 | 0.2518 |
| 5 | -0.5159 | 0.1715 | -0.0025 | -0.0415 | -0.0296 | -0.3377 | -0.2230 | -0.1569 | -0.1533 | 0.2822 |
| 6 | -0.5580 | 0.1454 | -0.0570 | -0.0561 | 0.0294 | -0.3434 | -0.2400 | -0.1611 | -0.1475 | 0.2414 |
| 7 | -0.5435 | 0.1385 | -0.0206 | -0.0740 | -0.0133 | -0.3589 | -0.1959 | -0.0780 | -0.1421 | 0.1507 |
| 8 | -0.5640 | -0.0016 | -0.0067 | -0.0326 | -0.0228 | -0.4532 | -0.1722 | -0.1667 | -0.1435 | 0.1588 |
| 9 | -0.4962 | 0.1153 | -0.0645 | -0.0158 | 0.0227 | -0.4229 | -0.2301 | -0.1647 | -0.1312 | 0.2367 |
| 10 | -0.5670 | 0.2279 | -0.0303 | -0.0542 | 0.0077 | -0.2484 | -0.2189 | -0.1222 | -0.0629 | 0.6166 |
| 11 | -0.5190 | 0.1858 | -0.0275 | -0.1000 | 0.0027 | -0.3598 | -0.2289 | -0.1075 | -0.0755 | 0.2257 |
| 12 | -0.5449 | 0.1736 | -0.0124 | -0.0898 | -0.0235 | -0.3489 | -0.2097 | -0.1369 | -0.1028 | 0.3149 |
| 13 | -0.5202 | 0.1706 | -0.0137 | -0.0677 | -0.0205 | -0.3346 | -0.2398 | -0.2126 | -0.1640 | 0.3460 |
| 14 | -0.5326 | 0.1523 | -0.0453 | -0.0035 | -0.0232 | 0.2480 | -0.1751 | -0.1358 | -0.0745 | 0.7144 |
| 15 | -0.5067 | 0.1030 | -0.0619 | -0.0185 | -0.0315 | 0.3505 | -0.2091 | -0.1824 | -0.1345 | 0.3462 |

BASELINE - POST-T7

| | CWY | HSZ | KTX | LTY | JTX | GWZ | AWY | IWY | FWY | BCS.TP |
|---|---|---|---|---|---|---|---|---|---|---|
| 1 | -0.6772 | 0.3733 | 0.0598 | -0.0834 | -0.0375 | 0.2415 | -0.7145 | -0.3147 | -0.0542 | 2.3139 |
| 2 | -0.4249 | -0.3925 | -0.2253 | 0.5823 | 0.2552 | -0.4752 | 0.5203 | 0.5495 | 1.0240 | 0.9291 |
| 3 | -0.3193 | -0.0046 | -0.2046 | 0.0489 | 0.2329 | -0.2792 | -0.3154 | 0.3023 | 0.6489 | 1.2057 |
| 4 | -1.1261* | 0.9589* | 0.1644* | -0.5018* | -0.1296* | 0.1962* | -0.3902* | -0.5357* | -0.2510* | 2.3543* |
| 5 | -1.4217 | -0.2653 | 0.0109 | 0.4125 | 0.0369 | -0.3018 | -0.7457 | -0.3162 | -0.1735 | 0.6814 |
| 6 | -0.9860* | -0.2404* | 0.1063* | -0.0053* | -0.1149* | -0.5909* | -0.7349* | -0.5787* | -0.3979* | 0.2308* |
| 7 | -2.1317* | 0.9086* | 0.1907* | -0.8196* | -0.1775* | -0.1662* | -0.1403* | -0.5776* | -0.5033* | 0.9432* |
| 8 | -1.3577* | 0.3127* | 0.1761* | -0.2548* | -0.1809* | -0.2787* | -0.6391* | -0.4975* | -0.2578* | 1.0502* |
| 9 | -1.5788* | 0.3482* | 0.0832* | -0.4734* | -0.0209* | -0.2409* | -0.9182* | -0.0011* | 0.2638* | 0.9757* |
| 10 | -1.1077* | 0.6310* | 0.0252* | -0.4363* | -0.0416* | -0.0470* | -0.5662* | -0.0335* | 0.3276* | 1.7333* |
| 11 | -0.3098 | 0.1859 | -0.1650 | -0.2108 | 0.1408 | -0.1676 | -0.3519 | 0.4703 | 0.8974 | 1.8492 |
| 12 | -1.4443* | 0.1061* | 0.1370* | -0.2453* | -0.0867* | -0.4253* | -0.8326* | -0.5931* | -0.3946* | 0.6302* |
| 13 | -1.4685* | -0.5484* | 0.1410* | -0.6094* | -0.1300* | -0.3110* | -0.2577* | -0.7132* | -0.4424* | 1.1320* |
| 14 | -1.8815* | 0.0198* | 0.0106* | -0.2012* | 0.0685* | -0.3688* | -1.0267* | -0.2122* | 0.1103* | 0.5164* |
| 15 | -1.3455* | 0.1016* | -0.0773* | -0.5516* | 0.1068* | -0.3149* | -1.0030* | 0.2686* | 0.6143* | 1.4618* |

FIG. 9

DOE 7 PRE-PIST

| | CWY | HSZ | KTX | LTY | JTX | GWZ | AWY | BCS.TP | FWY |
|---|---|---|---|---|---|---|---|---|---|
| 1 | -0.397 | 0.201 | -0.104 | -0.172 | 0.126 | -0.107 | -0.346 | 0.759 | -0.204 |
| 2 | -0.404 | 0.198 | -0.150 | -0.150 | 0.171 | -0.147 | -0.320 | 0.606 | -0.248 |
| 3 | -0.401 | 0.198 | -0.116 | -0.129 | 0.143 | -0.118 | -0.321 | 0.879 | -0.262 |
| 4 | -0.392 | 0.123 | -0.039 | -0.054 | 0.064 | -0.079 | -0.325 | 0.584 | -0.305 |
| 5 | -0.389 | 0.157 | -0.104 | -0.140 | 0.127 | -0.131 | -0.308 | 0.553 | -0.238 |
| 6 | -0.426 | 0.165 | -0.074 | -0.193 | 0.096 | -0.111 | -0.284 | 0.487 | -0.236 |
| 7 | -0.313 | 0.203 | -0.148 | -0.144 | 0.171 | -0.129 | -0.326 | 0.602 | -0.189 |
| 8 | -0.455 | 0.181 | -0.062 | -0.171 | 0.081 | -0.114 | -0.300 | 0.521 | -0.256 |
| 9 | -0.432 | 0.180 | -0.093 | -0.157 | 0.119 | -0.119 | -0.278 | 0.476 | -0.218 |
| 10 | -0.419 | 0.183 | -0.112 | -0.158 | 0.137 | -0.133 | -0.318 | 0.481 | -0.220 |
| 11 | -0.421 | 0.142 | -0.083 | -0.155 | 0.107 | -0.142 | -0.315 | 0.453 | -0.208 |
| 12 | -0.433 | 0.147 | -0.141 | -0.150 | 0.164 | -0.164 | -0.297 | 0.514 | -0.239 |
| 13 | -0.428 | 0.175 | -0.108 | -0.139 | 0.130 | -0.115 | -0.289 | 0.610 | -0.219 |

DOE 7 POST-PIST

| | CWY | HSZ | KTX | LTY | JTX | GWZ | AWY | BCS.TP | FWY |
|---|---|---|---|---|---|---|---|---|---|
| 1 | -0.521 | 0.380 | -0.137 | -0.269 | 0.163 | 0.036 | -0.341 | 1.199 | -0.136 |
| 2 | -0.647 | 0.375 | -0.106 | -0.354 | 0.151 | 0.000 | -0.359 | 0.926 | -0.303 |
| 3 | -0.483 | 0.228 | -0.135 | -0.158 | 0.198 | 0.013 | -0.265 | 1.358 | -0.122 |
| 4 | -0.523 | 0.294 | -0.159 | -0.124 | 0.200 | 0.119 | -0.327 | 1.301 | -0.121 |
| 5 | -0.542 | 0.237 | -0.166 | -0.225 | 0.208 | 0.028 | -0.374 | 1.077 | -0.064 |
| 6 | -0.639 | 0.361 | -0.115 | -0.358 | 0.187 | 0.075 | -0.274 | 0.952 | -0.219 |
| 7 | -0.601 | 0.323 | -0.151 | -0.334 | 0.193 | 0.008 | -0.344 | 0.943 | -0.201 |
| 8 | -0.467 | 0.298 | -0.173 | -0.118 | 0.212 | -0.019 | -0.267 | 0.918 | -0.090 |
| 9 | 0.207 | -0.023 | -0.295 | -0.254 | 0.350 | -0.029 | 0.439 | 0.952 | -0.003 |
| 10 | -0.427 | 0.361 | -0.128 | -0.233 | 0.156 | 0.027 | -0.179 | 1.007 | -0.105 |
| 11 | -0.368 | 0.266 | -0.154 | -0.156 | 0.213 | -0.025 | -0.190 | 0.832 | -0.095 |
| 12 | -0.519 | -0.367 | -0.356 | 0.359 | 0.414 | -0.102 | -0.093 | 1.266 | 0.223 |
| 13 | -0.504 | 0.459 | -0.108 | -0.310 | 0.137 | 0.055 | -0.276 | 1.080 | -0.290 |

FIG. 10

| RUN | SHT - TEMP (C) | SHT TIME (HRS) | QUENCH DELAY (SEC) | QUENCH TEMP (C) | AA - TEMP (C) | AA - TIME (HRS) | AVG. YIELD STRENGTH (MPa) | YS ST. DEV (MPa) | BENDABILITY r/t < 0.30 |
|---|---|---|---|---|---|---|---|---|---|
| 1 | 508 | 4 | 20 | 88 | 200 | 6 | 248 | 3 | NO |
| 2 | 508 | 4 | 20 | 88 | 200 | 8 | 245 | 2 | NO |
| 3 | 508 | 4 | 20 | 88 | 215 | 6 | 225 | 3 | YES |
| 4 | 508 | 4 | 20 | 88 | 215 | 8 | 227 | 3 | YES |
| 5 | 508 | 4 | 20 | 88 | 230 | 6 | 211 | 4 | YES |
| 6 | 508 | 4 | 20 | 88 | 230 | 8 | 207 | 4 | YES |
| 7 | 519 | 4 | 20 | 88 | 215 | 6 | 250 | 4 | NO |
| 8 | 519 | 4 | 20 | 88 | 215 | 8 | 250 | 3 | NO |
| 9 | 519 | 4 | 20 | 88 | 230 | 6 | 231 | 3 | YES |
| 10 | 519 | 4 | 20 | 88 | 230 | 8 | 224 | 3 | YES |
| 11 | 519 | 4 | 20 | 88 | 245 | 2 | 230 | 2 | YES |
| 12 | 519 | 4 | 20 | 88 | 245 | 4 | 213 | 3 | YES |
| 13 | 530 | 4 | 20 | 88 | 215 | 6 | 266 | 4 | NO |
| 14 | 530 | 4 | 20 | 88 | 215 | 8 | 262 | 5 | NO |
| 15 | 530 | 4 | 20 | 88 | 230 | 6 | 249 | 4 | YES |
| 16 | 530 | 4 | 20 | 88 | 230 | 8 | 240 | 3 | YES |
| 17 | 530 | 4 | 20 | 88 | 245 | 2 | 251 | 1 | YES |
| 18 | 530 | 4 | 20 | 88 | 245 | 4 | 229 | 3 | YES |

FIG. 11

| RUN NUMBER | SOLUTION TEMP (°C) | SHT TIME (HR) | QUENCH TEMP (°C) | AA TEMP (°C) | AA TIME (HR) | AVG. YIELD STRENGTH (MPa) | YS ST. DEV (MPa) | BENDABILITY r/t < 0.30 | POST AA - PIST %* |
|---|---|---|---|---|---|---|---|---|---|
| 1 | 502 | 3 | 56 | 230 | 6 | 197 | 7 | YES | 83% |
| 2 | 530 | 3 | 56 | 230 | 6 | 230 | 20 | YES | 77% |
| 3 | 530 | 3 | 88 | 230 | 6 | 243 | 14 | NO | 90% |
| 4 | 516 | 3 | 72 | 230 | 6 | 215 | 7 | YES | 87% |
| 5 | 502 | 3 | 88 | 230 | 6 | 200 | 23 | YES | 94% |
| 6 | 502 | 3 | 56 | 230 | 6 | 130 | 25 | YES | 99% |
| 7 | 502 | 3 | 88 | 230 | 6 | 123 | 18 | YES | 100% |
| 8 | 530 | 3 | 88 | 230 | 6 | 248 | 21 | NO | 93% |
| 9 | 530 | 3 | 56 | 230 | 6 | 218 | 18 | YES | 96% |
| 10 | 516 | 3 | 72 | 230 | 6 | 180 | 16 | YES | 89% |
| | | | | | | | | | * TARGET: 100% |

PRE-PIST MEASUREMENT

| PART | CWY | HSZ | KTX | LTY | JTX | GWZ | AWY | IWY | FWY | BCS.TP |
|---|---|---|---|---|---|---|---|---|---|---|
| 4 | -0.4252 | 0.2281 | -0.0399 | -0.0533 | 0.0389 | -0.2655 | -0.0897 | 0.5462 | -0.1178 | 0.1180 |
| 5 | -0.4411 | 0.1143 | -0.0549 | -0.0102 | 0.0316 | -0.3963 | -0.1072 | 0.6342 | -0.1034 | 0.5999 |
| 9 | -0.4335 | 0.1549 | -0.0821 | -0.0411 | 0.0573 | -0.2486 | -0.1277 | 0.5391 | -0.0688 | 0.1095 |
| 10 | -0.4244 | 0.1086 | 0.0499 | -0.0120 | -0.0331 | -0.3554 | -0.1336 | 0.5854 | -0.1156 | 0.2916 |
| 13 | -0.3873 | 0.0083 | -0.0261 | -0.0825 | -0.0037 | -0.4671 | -0.2112 | -0.1786 | -0.1622 | 0.1006 |
| 14 | -0.5260 | 0.0143 | 0.0137 | -0.0585 | -0.0229 | -0.3050 | -0.1807 | -0.1301 | -0.1085 | 0.3738 |
| 15 | -0.5058 | 0.0347 | -0.0421 | -0.0589 | 0.0048 | -0.4203 | -0.1837 | -0.0452 | -0.0996 | 0.1690 |
| 16-A | -0.3938 | 0.1529 | 0.0376 | 0.0143 | -0.0338 | -0.2319 | -0.1394 | 0.5083 | -0.1363 | 0.0784 |
| 16-B | -0.5167 | 0.1358 | 0.0212 | -0.0676 | -0.0453 | -0.2412 | -0.1942 | -0.1445 | -0.1196 | 0.5985 |
| 17 | -0.5841 | -0.0167 | 0.0116 | -0.0327 | -0.0314 | -0.3858 | -0.1915 | -0.1224 | -0.0837 | 0.3812 |
| 18 | -0.5927 | -0.1524 | -0.0016 | 0.0326 | -0.0003 | -0.4621 | -0.1667 | -0.0509 | -0.0259 | 0.1613 |
| 19 | -0.5356 | -0.0090 | 0.0425 | -0.0540 | -0.0616 | -0.4981 | -0.2576 | -0.1825 | -0.2206 | 0.3149 |
| 20 | -0.5381 | 0.1302 | 0.0671 | -0.1134 | -0.0693 | -0.3076 | -0.2654 | -0.1550 | -0.1576 | 0.4785 |
| 28 | -0.4027 | 0.0521 | -0.0708 | 0.0921 | 0.0576 | -0.4294 | -0.1062 | 0.4970 | -0.1256 | 0.4033 |
| 31 | -0.3966 | 0.2440 | -0.0164 | 0.1026 | 0.0290 | -0.1588 | -0.0963 | 0.6294 | -0.0168 | 0.3278 |
| 33 | -0.4895 | 0.0021 | -0.0323 | -0.0026 | 0.0288 | -0.4660 | -0.0956 | 0.5473 | -0.1231 | 0.7043 |
| 34 | -0.3587 | 0.0894 | 0.0039 | 0.0178 | -0.0258 | -0.2172 | -0.1301 | 0.5909 | -0.0668 | 0.1865 |
| 37 | -0.4132 | -0.0435 | -0.0823 | 0.0061 | 0.0596 | -0.4595 | -0.1332 | 0.6102 | -0.0596 | 0.5116 |
| 40 | -0.3725 | 0.1055 | -0.0009 | -0.0067 | -0.0155 | -0.2867 | -0.1392 | 0.5560 | -0.0967 | 0.0925 |
| 41 | -0.4188 | 0.0365 | -0.0236 | -0.0190 | 0.0074 | -0.3158 | -0.1473 | 0.6217 | -0.0450 | 0.0840 |
| 44 | -0.4062 | -0.0116 | -0.0195 | -0.0016 | -0.0315 | -0.2714 | -0.1657 | 0.5874 | -0.0959 | 0.1581 |
| 48 | -0.4075 | -0.0773 | -0.0536 | -0.0037 | -0.0552 | -0.2728 | -0.1568 | 0.5543 | -0.1110 | 0.0986 |
| | PIST: | 100% | | | | | | | | |

POST-PIST MEASUREMENT

| PART | CWY | HSZ | KTX | LTY | JTX | GWZ | AWY | IWY | FWY | BCS.TP |
|---|---|---|---|---|---|---|---|---|---|---|
| 4 | -0.5419 | 0.3625 | -0.0498 | -0.0415 | 0.0594 | -0.1203 | -0.2830 | 0.2988 | -0.1701 | 0.7522 |
| 5 | -0.4000 | 0.2202 | -0.0888 | 0.0794 | 0.1075 | -0.1208 | -0.3270 | 0.5643 | 0.0628 | 0.4536 |
| 9 | -0.4102 | 0.4546 | -0.1001 | -0.0193 | 0.1101 | 0.0395 | -0.3216 | 0.3794 | -0.0297 | 1.0494 |
| 10 | -0.5119 | 0.1851 | 0.0378 | 0.0536 | -0.0371 | -0.1783 | -0.1467 | 0.4547 | 0.0192 | 0.6037 |
| 13 | -0.8874* | 0.4893* | 0.0334* | -0.2405* | -0.0488* | -0.1414* | -0.3428* | -0.4964* | -0.3066* | 0.9862* |
| 14 | -0.5930 | 0.3175 | -0.0346 | -0.1103 | 0.0352 | -0.1545 | -0.2993 | -0.3351 | -0.1123 | 1.0178 |
| 15 | -0.5657 | 0.3019 | -0.0221 | -0.0138 | 0.0377 | -0.1186 | -0.3065 | -0.2356 | -0.0941 | 0.9173 |
| 16-A | -0.5272 | -0.3829 | -0.0583 | -0.0449 | 0.0451 | -0.0304 | -0.3390 | -0.2252 | 0.0198 | 1.4540 |
| 16-B | -0.2924 | 0.1212 | -0.0944 | 0.2084 | 0.1235 | -0.1214 | -0.2587 | -0.5258 | 0.1259 | 0.6233 |
| 17 | -0.5866 | 0.2737 | -0.0707 | -0.0115 | 0.0802 | -0.1723 | -0.3136 | -0.2946 | -0.0517 | 1.1357 |
| 18 | -0.6345 | 0.1545 | -0.0300 | 0.0286 | 0.0477 | -0.0938 | -0.2321 | -0.2583 | -0.0359 | 1.2436 |
| 19 | -0.6216 | 0.2024 | -0.0305 | -0.0222 | 0.0310 | -0.3368 | -0.2600 | -0.2599 | -0.0818 | 0.5026 |
| 20 | -0.5903 | 0.2564 | -0.0170 | 0.0459 | 0.0167 | -0.2124 | -0.4005 | -0.4045 | -0.2374 | 0.8247 |
| 28 | -0.5567 | 0.3652 | -0.0738 | 0.0446 | 0.0961 | -0.1676 | -0.3840 | 0.1852 | -0.1481 | 0.9069 |
| 31 | -0.5487 | 0.2541 | -0.0678 | 0.2177 | 0.1051 | -0.0158 | -0.2639 | 0.4592 | 0.0206 | 1.0253 |
| 33 | -0.5540 | 0.0584 | -0.0522 | 0.1233 | 0.0671 | -0.2738 | -0.2713 | 0.3172 | -0.1451 | 0.1006 |
| 34 | -0.6222 | 0.1836 | -0.0074 | 0.0002 | 0.0069 | -0.1979 | -0.3192 | 0.2474 | -0.2402 | 0.4483 |
| 37 | -0.5497 | 0.2216 | -0.1071 | 0.0764 | 0.1375 | -0.0794 | -0.3359 | 0.4231 | -0.0389 | 0.7245 |
| 40 | -0.5340 | 0.0787 | -0.0461 | 0.1335 | 0.0626 | -0.2975 | -0.2329 | 0.4520 | -0.0667 | 0.1471 |
| 41 | -0.5493 | 0.3818 | -0.0660 | -0.0298 | 0.0524 | -0.0837 | -0.1074 | 0.4781 | 0.0326 | 0.6972 |
| 44 | -0.5307 | 0.2630 | -0.0587 | 0.0699 | 0.0577 | -0.1928 | -0.2957 | 0.3287 | -0.1556 | 0.3985 |
| 48 | -0.5793 | 0.0070 | -0.0954 | 0.1584 | 0.1320 | -0.1565 | -0.3120 | 0.4834 | 0.0508 | 0.6093 |
| | PIST %: | 99.55% | | | | | | | | |

FIG. 14

HEAT TREATMENT FOR REDUCING DISTORTION

TECHNICAL FIELD

The present disclosure relates to heat treatments, for example, for reducing or minimizing distortion in metals.

BACKGROUND

One approach to reducing vehicle weight in automotive design is with aluminum intensive vehicles (AIVs). AIVs have often been based on the unibody design of steel vehicle architectures, which are assemblies of stamped sheet components. Automotive AIV design has focused primarily on the 5XXX and 6XXX series aluminum sheet, as they can be shaped and processed by methods consistent with those already used in automotive manufacturing of steel sheet (e.g., sheet stamping, automated assembly, paint process). These alloys may have strengths equivalent to the mild steel sheet generally used in steel vehicle platforms. The 6XXX series aluminum alloys may experience improved mechanical strength properties when certain heat treatment processes are performed.

For some applications, multiple components, such as metal sheet, may be joined. One method for mechanically joining multiple components, such as 2T, 3T and 4T material stack-ups (e.g., 2, 3, or 4 sheets in a stack), may include the use of self-piercing rivets (SPRs). A SPR is a cold joining riveting process used to fasten two or more sheets of material by driving rivets through the top sheet(s), which may create a "button" on the bottom sheet. However, if the sheets do not have sufficient joinability or rivetability, then defects may occur in the sheets and/or the rivet. Examples of defects may include radial cracking of the rivet button, cracking in the side wall of the rivet button, a crack in the stack, or buckling of the rivet legs. In general, higher strength materials tend to have lower joinability. Therefore, joining processes, such as SPRs, may result in joining defects when multiple high strength components are joined.

SUMMARY

In at least one embodiment, a method of processing an aluminum alloy component, is provided. The method may include solution heat treating the component at a solution heat treatment (SHT) temperature of 500° C. to 535° C.; quenching the component in a liquid quenching medium having a temperature of 75° C. to 95° C.; and artificially aging the component at an artificial aging (AA) temperature of 200° C. to 250° C. to a yield strength of at least 200 MPa.

The component may be a 6XXX series aluminum alloy. In one embodiment, the artificially aging step includes artificially aging the component to an r/t ratio of less than 0.3. In another embodiment, the SHT temperature is from 505° C. to 530° C. The solution heat treating step may include heat treating the component for 2 to 4 hours. The liquid quenching medium may have a temperature of 80° C. to 90° C. In another embodiment, the liquid quenching medium has a temperature of 82° C. to 88° C. The liquid quenching medium may be water. In one embodiment, the artificially aging step includes heat treating the component for 2 to 8 hours. The method may further include joining the aluminum alloy component to a second component with a self-piercing rivet.

In at least one embodiment, a method of processing an aluminum alloy component is provided. The method may include solution heat treating the component at a solution heat treatment (SHT) temperature of 505° C. to 530° C. for 2 to 4 hours; quenching the component in a liquid quenching medium having a temperature of 80° C. to 90° C.; and artificially aging the component to a yield strength of at least 200 MPa.

In one embodiment, the artificial aging step includes heat treating the component at an artificial aging (AA) temperature of 200° C. to 250° C. for 2 to 8 hours. The component may be a 6XXX series aluminum alloy. In one embodiment, the artificially aging step includes artificially aging the component to an r/t ratio of less than 0.3. The liquid quenching medium may be water. The method may further include joining the aluminum alloy component to a second component with a self-piercing rivet.

In at least one embodiment, a method of forming a structural vehicle component is provided. The method may include stamping a sheet of an 6XXX series aluminum alloy in a progressive die to form a component having at least two non-coplanar surfaces; solution heat treating the component; quenching the component in a liquid quenching medium having a temperature of 75° C. to 95° C.; and artificially aging the component to a yield strength of at least 200 MPa and an r/t ratio of at most 0.3.

In one embodiment, the solution heat treating step includes heat treating the component at a solution heat treatment (SHT) temperature of 505° C. to 530° C. for 2 to 4 hours and the artificial aging step includes heat treating the component at an artificial aging (AA) temperature of 200° C. to 250° C. for 2 to 8 hours. The liquid quenching medium may be water and may have a temperature of 82° C. to 88° C. The method may further include joining the stamped 6XXX series aluminum alloy component to a second component with a self-piercing rivet.

BRIEF DESCRIPTION OF THE DRAWINGS

FIG. 9 is comparison of pre and post-heat treatment dimensions of a plurality of components following a previous T7 heat treatment;

FIG. 10 is a comparison of pre and post-heat treatment dimensions of a plurality of components following a modified T7 heat treatment, according to an embodiment;

FIG. 11 is a table of solution heat treatment, quench, and artificial aging parameters, according to several embodiments, and resulting properties for a plurality of components;

FIG. 14 is a comparison of pre and post-heat treatment dimensions of a plurality of components following a modified T7 heat treatment, according to an embodiment.

DETAILED DESCRIPTION

Figure 1:
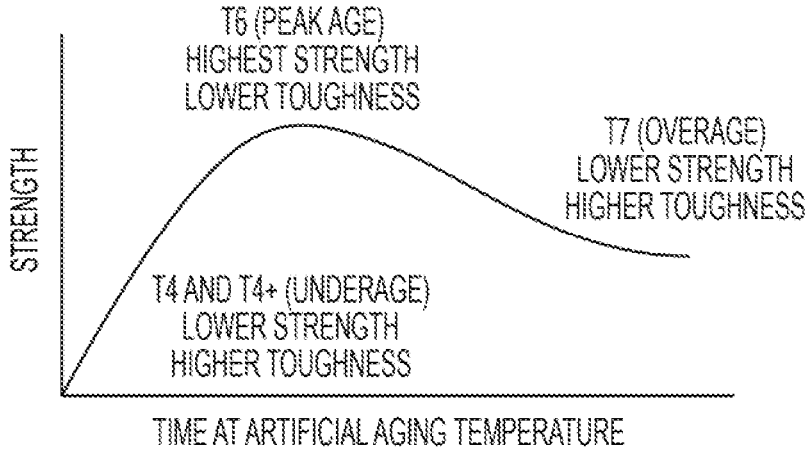
FIG. 1 is a schematic graph of strength versus artificial aging time showing several tempering stages of aluminum alloys.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Aluminum alloys are generally identified by a four-digit number, wherein the first digit generally identifies the major alloying element. Additional numbers represented by the letter "x" in the series designation define the exact aluminum alloy. For example, the major alloying element of 5XXX series is magnesium and for 6XXX series they are magnesium and silicon. 5XXX and 6XXX series aluminum alloys, which are aluminum-magnesium and aluminum-magnesium-silicon alloys, respectively. The 5XXX and 6XXX series aluminum alloys may be shaped and processed by methods consistent with those of mild steel sheets. The 7XXX series, which generally have high strengths, have aluminum and zinc as the major alloying elements.

Examples of specific 6XXX series alloys may include 6061, which may have a composition including 0.4-0.8% silicon, up to 0.7% iron, 0.15-0.40% copper, up to 0.15% manganese, 0.8-1.2% magnesium, 0.04-0.35% chromium, up to 0.25% zinc, up to 0.15% titanium, and other elements up to 0.05% each (0.15% total), all percentages by weight with the balance being aluminum. Numerous automotive components may include 6061 aluminum, such as brackets, body components, fasteners, and others. Another specific example of a 6XXX series alloy may be 6111, which may have a composition including 0.5-1% magnesium, 0.6-1.1% silicon, 0.5-0.9% copper, 0.1-0.45% manganese, up to 0.4% iron, up to 0.15% zinc, up to 0.1% chromium, up to 0.1% titanium and other elements up to 0.05% each (0.15% total), all percentages by weight with the balance being aluminum. Numerous automotive components may include 6111 aluminum, such as body panels, pillars, and others. Components including 6111 aluminum may require higher yield strength than those including 6061 aluminum. Other specific 6XXX series alloys are known in the art, such as 6009, 6010, 6016, 6022, 6053, 6063, 6082, 6262, 6463, or others.

6XXX and 7XXX series aluminum alloys may be age hardened (precipitation hardened) to increase their strength and/or toughness. Age hardening is preceded by a solution heat treatment (SHT, or solutionizing) and quench of the aluminum alloy material. A solution treatment generally includes heating the alloy to at least above its solvus temperature and maintaining it at the elevated temperature until the alloy forms a homogeneous solid solution or a single solid phase and a liquid phase. The temperature at which the alloy is held during solutionizing is known as the solution temperature. The solution temperature may be the temperature at which a substance is readily miscible. Miscibility is the property of materials to mix in all proportions, forming a homogeneous solution. Miscibility may be possible in all phases; solid, liquid and gas.

Following the solution treatment, a quenching step is performed in which the alloy is rapidly cooled to below the solvus temperature to form a supersaturated solid solution. Due to the rapid cooling, the atoms in the alloy do not have time to diffuse long enough distances to form two or more phases in the alloy. The alloy is therefore in a non-equilibrium state. Quenching may be done by immersing the alloy in a quenching medium, such as water or oil, or otherwise applying the quenching medium (e.g., spraying). Quenching may also be accomplished by bringing the alloy into contact with a cooled surface, for example, a water-cooled plate or die. The quench rate may be any suitable rate to form a supersaturated solution in the quenched alloy. The quench rate may be determined in a certain temperature range, for example from 400° C. to 290° C. The quench may be performed until the alloy is at a cool enough temperature that the alloy stays in a supersaturated state (e.g., diffusion is significantly slowed), such as about 290° C. The alloy may then be air cooled or otherwise cooled at a rate slower than the quench rate until a desired temperature is reached. Alternatively, the quench may be performed to a lower temperature, such as below 100° C. or down to about room temperature.

Age hardening includes heating and maintaining the alloy at an elevated temperature at which there are two or more phases at equilibrium. The supersaturated alloy forms fine, dispersed precipitates throughout as a result of diffusion within the alloy. The precipitates begin as clusters of atoms, which then grow to form GP zones, which are on the order of a few nanometers in size and are generally crystallographically coherent with the surrounding metal matrix. As the GP zones grow in size, they become precipitates, which strengthen the alloy by impeding dislocation movement. Since the precipitates are very finely dispersed within the alloy, dislocations cannot move easily and must either go around or cut through the precipitates in order to propagate.

Five basic temper designations may be used for aluminum alloys which are; F- as fabricated, O- annealed, H- train hardened, T- thermally treated, and W- as quenched (between solution heat treatment and artificial or natural aging). The as-received raw material for the disclosed solutionizing and age hardening processes may initially have any of the above temper designations. The temper designation may be followed by a single or double digit number for further delineation. An aluminum alloy with a T6 temper designation may be an alloy which has been solution heat treated and artificially aged, but not cold worked after the solution heat treatment (or such that cold working would not be recognizable in the material properties). T6 may represent the point of peak age yield strength along the yield strength vs. time and temperature profile for the material. A 6XXX series aluminum alloy having a T6 temper may have a yield strength of at least 240 MPa. For example, 6061 at a T6 temper may have a yield strength of about 275 MPa and 6111 at a T6 temper may have a yield strength of about 300 MPa. A T7 temper may designate that a solution heat treatment has occurred, and that the material was artificially aged beyond the peak age yield strength (over-aged) along the yield strength vs. time and temperature profile. A T7 temper material may have a lower yield strength than a T6 temper material, but the T7 temper may improve other properties, such as increased toughness compared to the T6 temper. A T8 temper is similar to a T7 temper in that it is aged beyond the peak yield strength (e.g., T6), however, a material with a T8 temper is artificially aged after the material has been cold worked. For example, sheets of 6111 alloy may be stamped in a T4 temper and then age hardened to T8, thereby forming a T8 temper.

The relative strengths and toughnesses of 6XXX series aluminum alloys as a function of aging time are illustrated in FIG. 1. As discussed above, T6 represents peak aging and the highest yield strength, while T7 represents over-aging and reduced (but still improved) yield strength. The T8 temper is not shown on the graph, but is similar to T7 in that it has lower yield strength than the T6 and lies to the right of the T6 peak-age. The T4 temper is shown to the left of peak aging, and may have properties similar to T7/8 (e.g., reduced strength and increased toughness relative to T6), but represents under-aging rather than over-aging. Under-aging to a T4 temper may be substituted for age hardening to T7 or T8 tempers in the present disclosure, however, under-aging may be more difficult to control and repeat. Therefore, over-aging may be a more robust and consistent process compared to under-aging.

T7 and T8 temper aluminum alloys (e.g., 6XXX and 7XXX) generally have increased bending toughness compared to the T6 temper. One method of measuring toughness may include determining the type of failure that a component exhibits after deformation. For example, when a sheet or coupon of material is bent to failure, the failure may be transgranular or intergranular. Transgranular failure, or failure across or through the grains of the alloy may indicate higher toughness than intergranular failure, where failure occurs along grain boundaries (e.g., between grains). Intergranular failure may occur when the grain boundaries are brittle or weak, which may be due to alloy composition, the type of heat treatment, or other factors (or a combination thereof). The T7 and T8 alloys disclosed herein may exhibit transgranular failure rather than intergranular failure during bending due to their increased toughness (e.g., compared to T6).

While the bending toughness of the T7 and T8 tempers may be greater than that of a T6 temper, a 6XXX series aluminum at a T7 or T8 temper may have a lower yield strength than a T6 temper due to over-aging. However, 6XXX series alloys age hardened according to the disclosed embodiments may maintain a yield strength of at least 200 MPa. For example, certain alloys (e.g., 6061) age hardened to a T7 or T8 temper (e.g., using the age hardening treatments described above) may have a yield strength of at least 200, 210, 220, 230, 240 MPa or higher. Some alloys (e.g., 6111) may have higher yield strengths following an age hardening heat treatment (e.g., as described above), for example, at least 250, 260, 270, 280, 290 MPa or higher.

The ability of an aluminum alloy component or member to be joined to other components or members may be described as its "joinability." One method of joining components to one another is riveting. Traditional rivets have a head and a cylindrical body, the body is inserted into a hole in the components to be joined and then deformed to form a second head. Self-piercing rivets (SPRs) are another form of rivets in which no pre-formed holes in the components to be joined are necessary. SPRs generally include a hardened, semi-tubular body that is inserted into the top component(s) to be joined, but does not penetrate all the way through the bottom component. A bottom die is placed below the bottom component, which causes the SPR to flare and form an annular button on the bottom component.

Figure 2:
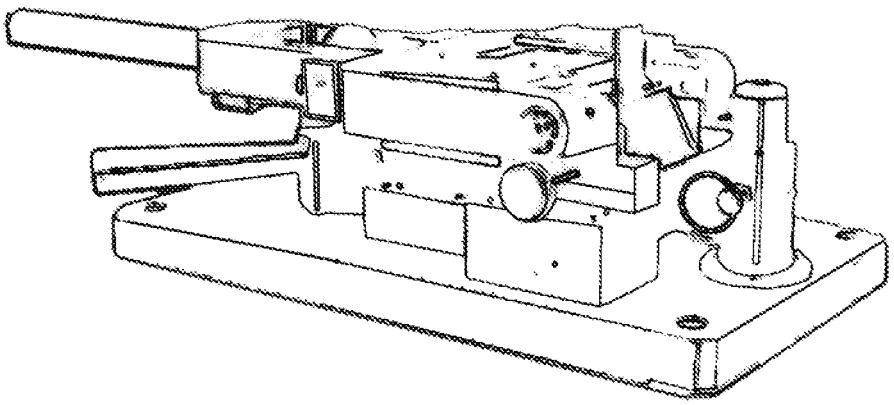
FIG. 2 is a photograph of a semi-guided wrap-bend tester, which may be used to test bendability of an aluminum alloy.
Figure 3:
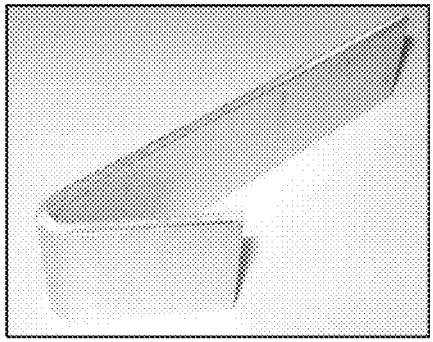
FIG. 3 is an example of a coupon tested using the wrap-bend tester of FIG. 2.

In addition, it has been discovered that joinability (e.g., ability to be riveted) may be correlated to and/or predicted by bendability measurements. Bendability, as used in the present disclosure, may be quantified using an "r/t ratio," which is the ratio of the bend radius (r) to the sheet thickness (t). The smaller the r/t ratio, the more bendable the sheet is. An example of a piece of equipment used to measure bendability is shown in FIG. 2. The equipment shown is a semi-guided wrap-bend tester, which adheres to standards such as ASTM E290 and Ford Laboratory Test Method (FLTM) B114-02. Bendability may be defined and measured according to FLTM BB 114-02 and the r/t ratio may be calculated based on a prescribed bend rating. In at least one embodiment, the r/t ratio to failure may be calculated based on a bend rating of about 5 or more where a crack completely propagates across the width of the bent sample. The r/t to failure calculation may be considered a normalized, relative mechanical assessment of an aluminum alloy's toughness. An example of a coupon tested using the wrap-bend tester is shown in FIG. 3. In general, it has been discovered that 6XXX series aluminum alloys (e.g., 6061 and 61111) having a bendability r/t ratio of about 0.3 or less may be joined using SPRs without the above mentioned defects (e.g., stack or button cracking). Certain alloys may be joinable at higher r/t ratios, for example, 6111 alloys may be joinable at r/t ratios of up to about 0.4. Joinability may be possible at r/t ratios higher than 0.4, however the riveting process may not be robust at higher r/t ratios, which may lead to an unacceptable failure rate.

Figure 4:
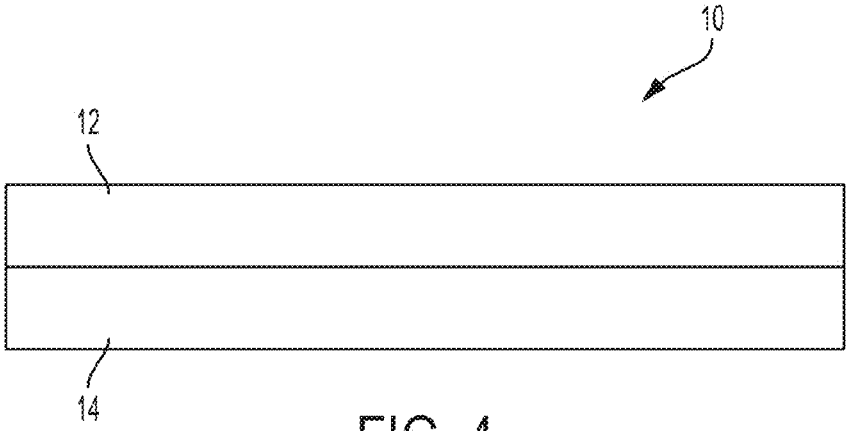
FIG. 4 is a cross-section of a stack of metal sheets to be joined, according to an embodiment.

In order to be used in certain vehicle applications, aluminum alloys (e.g., 6XXX series) must be able to be joined to other metal components. With respect to FIG. 4, a stack 10 of members or layers is shown. The stack 10 may have a top member 12 and a bottom member 14. In addition, there may be additional intermediate members/layers 16 (not shown) in between the top member 12 and bottom member 14. In one embodiment, the stack 10 has up to four layers: a top layer 12, a bottom layer 14, and one or two intermediate layers 16. At least one of the layers may be a 6XXX series aluminum alloy, which may have a T7 or T8 temper. In at least one embodiment, the bottom layer 14 is a 6XXX series aluminum alloy, which may have a T7 or T8 temper and the properties described above. The top layer 12, bottom layer 14, and any intermediate layer(s) 16 may be formed of the same material (e.g., a T7 or T8 temper 6XXX alloy). However, the one or more of the layers may be formed of different materials, such as other aluminum alloys or steels. The stack 10 may have a total thickness of up to 6, 8, 10, or 12 mm. Each layer may have a thickness of 0.5 to 5 mm, or any sub-range therein, such as 0.8 to 4 mm, 1 to 3.5 mm, or others. In one embodiment, the bottom layer 14 may be thicker than each of the other layers (however, it is not required to be thicker). For example, the bottom layer 14 may have a thickness of 1.5 to 4 mm, or any sub-range therein.

It has been found that the use of SPRs may not be feasible with 6XXX series aluminum alloys having a T6 temper. Numerous joining defects may occur when using SPRs on a stack having a T6 temper 6061 alloy as the bottom layer 14. Cracking within the stack 10 may occur. The bottom layer 14 may crack and at least partially separate around the edge of the button. The button itself may crack, for example, in the side wall. Radial cracking of the button may also occur. In addition, the legs of the SPR may buckle.

It has been discovered, however, that 6XXX series alloys having a T7 or T8 temper may have increased joinability, for example, with SPRs. Without being held to any particular theory, it is believed that the increased bending toughness of the T7/T8 temper alloys compared to the T6 temper alloys may improve the joinability. Cracking in the stack may be avoided, as well as cracks in the button (both in the side wall and radial cracks). In addition, the rivet (e.g., a SPR) may remain in intimate contact with the 6XXX aluminum alloy after riveting. Stated another way, the rivet may be in substantially continuous contact with the 6XXX aluminum alloy along the portion of the surface of the rivet that is embedded in the 6XXX alloy. For example, there may be no cracks in the 6XXX alloy or the SPR and/or no gaps between the 6XXX alloy and the surface of the SPR.

To achieve a T6 temper in a 6XXX series alloy, a solution heat treatment and quench is performed, as described above, followed by an age hardening heat treatment. The standard age hardening heat treatment to achieve a T6 temper in a 6XXX alloy may be at a temperature of about 160° C. to 180° C. for 6 to 18 hours (generally, if the temperature is near the top of the range then the time is towards the bottom of the range, and vice versa). However, there is no industry standard for tempering a 6XXX alloy to a T7 or T8 temper (e.g., no ASTM standard or military spec). A T7 temper was previously described in co-owned and co-pending U.S. application Ser. No. 14/189,050, the disclosure of which is hereby incorporated in its entirety by reference herein. In addition, an air-quenched T5 temper was previously described in co-owned and co-pending U.S. application Ser. No. 14/565,799, the disclosure of which is hereby incorporated in its entirety by reference herein.

In general, faster quenching of an age-hardenable aluminum alloy may result in a finished component that has a higher yield strength but lower toughness or bendability, compared to a slower quenched component of the same alloy. It has been found that faster quenching may also cause increased distortion in the component after the artificial aging heat treatment. However, elevated cooling temperatures have been found to result in lower yield strengths, which may render components unsuitable for certain applications. It has been discovered that for 6XXX series alloys, a certain threshold of distortion, yield strength, and bendability (an indication of toughness) may be attained by liquid quenching with a liquid medium having a certain range of temperatures above room/ambient temperature. In at least one embodiment, a 6XXX series component having a yield strength of at least 200 MPa, a bendability of $r/t \leq 0.3$, and reduced distortion may be achieved using a liquid quench and a modified solution heat treatment and artificial aging regimen.

Liquid quench medium temperatures are generally at or near room/ambient temperature, such as about 20° C. to 26° C. These quench medium temperatures may provide rapid cooling (e.g., 100's of ° C./second), resulting in high yield strengths. However, this rapid cooling may result in high levels of distortion in the finished parts, particularly those with more complex geometries. For example, the resultant magnitude of distortion at any given location on the part may be equal to greater than 0.5, 0.7, 1.0, or 1.5 mm from the target geometry surface for the part. The distortion may be increased or more problematic for larger and/or more complex components. For example, components having multiple mating surfaces may sustain distortion that is significant enough to cause misalignment or cause one or more components in a system to be outside acceptable tolerances.

Figure 5:
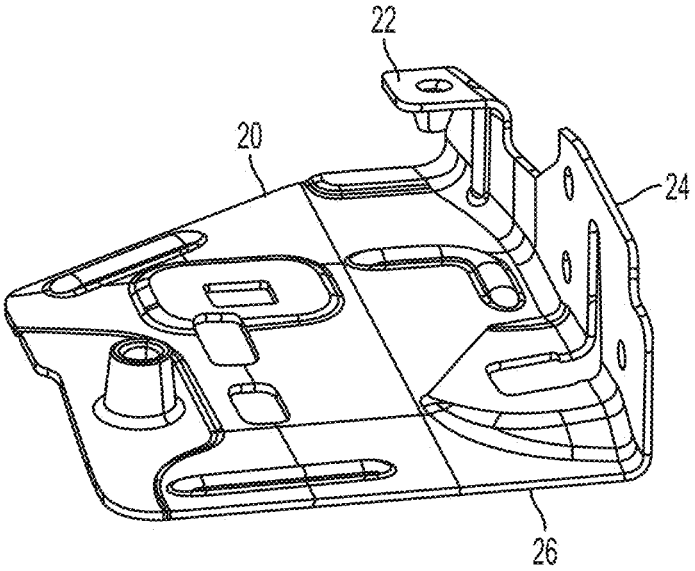
FIG. 5 is a front perspective view of a side door latch reinforcement component that may be produced according to the disclosed methods.
Figure 6:
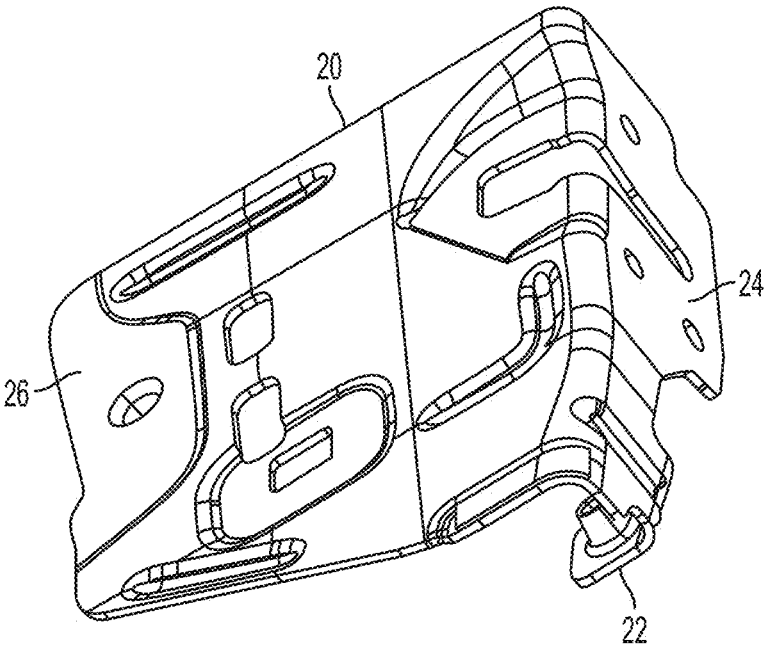
FIG. 6 is a rear perspective view the side door latch reinforcement component of FIG. 5.
Figure 7:
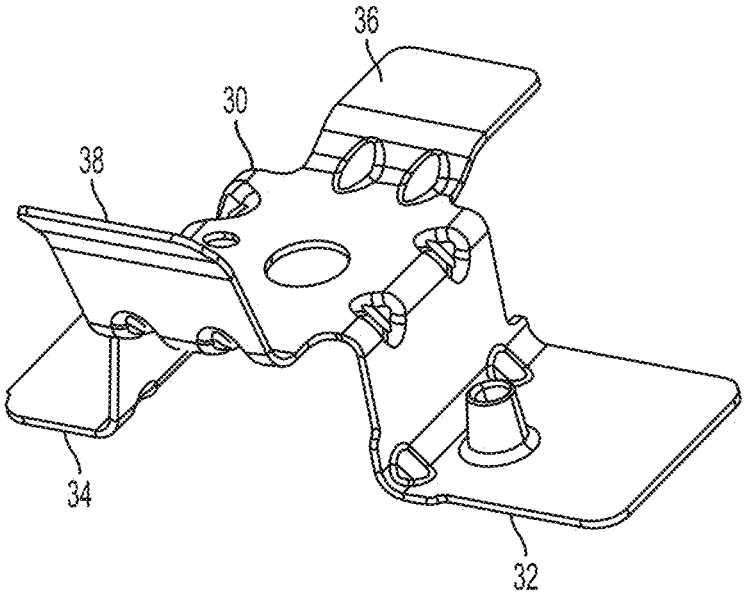
FIG. 7 is a perspective view of a floor pan reinforcement component that may be produced according to the disclosed methods.
Figure 8:
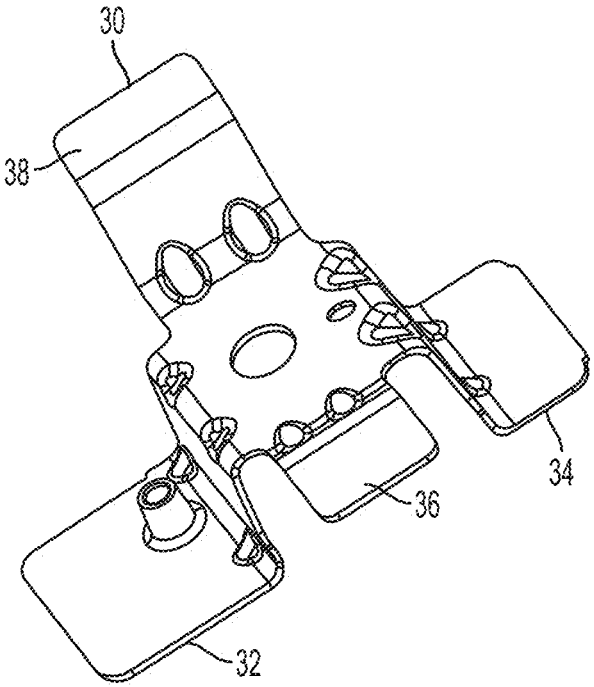
FIG. 8 is another perspective view the floor pan reinforcement component of FIG. 7.

The problem may be even more severe when a component has multiple, non-coplanar mating surfaces. Examples of two components having multiple, non-coplanar mating surfaces are shown in FIGS. 5-8. A side door latch reinforcement 20 is shown in FIGS. 5 and 6. The side door latch reinforcement 20 has multiple mating surfaces 22, 24, and 26, which are non-coplanar. If one or more of the mating surfaces 22, 24, or 26 are distorted beyond a certain acceptable tolerance or threshold, the other mating surfaces may be misaligned or out of specification. Misalignment may cause numerous problems, such as water/wind noise, visual misalignment, and door latching and/or sealing issues. A floor pan reinforcement 30 is shown in FIGS. 7 and 8. The floor pan reinforcement 30 has multiple mating surfaces 32, 34, 36, and 38. If one or more of the mating surfaces 32, 34, 36, or 38 are distorted beyond a certain acceptable tolerance or threshold, the other mating surfaces may be misaligned or out of specification. Distortion tolerances for mating surfaces may vary depending on the application, but in at least one embodiment, a distortion tolerance for a mating surface may be no more than ±1.5 mm, for example, less than or equal to ±1.0 mm, ±0.7 mm, or ±0.5 mm. Components manufactured using the disclosed processes may include a plurality of mating surfaces that are each within the distortion tolerance.

Aluminum alloys, for example 6XXX series aluminum alloys, such as 6061-O, may undergo distortion when heat treated using previous solution heat treatment and age hardening regimens. The distortion may be greater if the component has been cold-worked, such as by progressive stamping. With reference to FIG. 9, pre and post heat-treatment measurements are shown for a T7 heat treatment, with clear cells representing an in-specification measurement and shaded cells representing an out-of-specification measurement. The y-axis represents test samples 1 to 15 and the x-axis represents ten different test locations on each test sample. The +/− units are in mm from the specified location (e.g., −0.5 is 0.5 mm less than the specification). The T7 heat treatment performed for these samples included a solution heat treatment (SHT) of about 529° C. for 3 hours and quenching using liquid water at about 54° C. The artificial aging process included a temperature of 230° C. for 6 hours. The resulting components had an average yield strength of 235 MPa and a bendability ratio (r/t ratio) of less than 0.30, which are quite good. However, as shown in FIG. 9, a significant number of samples included multiple out-of-specification locations, which may be unacceptable for certain applications.

In an attempt to improve the distortion values, another heat treatment process was performed with a reduced solution heat treatment temperature of about 503° C. and increased quench temperature of about 88° C. The SHT time and the AA temperature and time were maintained the same. The distortion results, shown in FIG. 10, indicate the distortion was greatly reduced and that all 15 samples were in-specification at all locations. However, the modified heat treatment resulted in a significant loss of yield strength, having an average of 124 MPa. Accordingly, while the modified heat treatment significantly improved the distortion of the parts compared to the original heat treatment, the yield strength properties were reduced to a level that may be unacceptable in certain applications (e.g., certain structural automotive components).

It has been discovered that by modifying the solution heat treatment, quenching, and artificial aging heat treatment parameters (e.g., temperature and time), age-hardened 6XXX series aluminum alloy components having a high yield strength (e.g., at least 200 MPa), good bendability (e.g., r/t ratio less than 0.3), and low levels of distortion may be provided. It has been found that each parameter may have a substantial impact on these properties and that adjustments to one parameter may require adjustments to the other parameters in order to maintain the above properties.

It has been found that, in general, lower SHT temperatures may reduce or minimize distortion. However, adjusting the SHT temperature alone may not provide sufficient reduction in distortion for certain part compositions and/or geometries. It has further been found that increasing the temperature of the quenching medium, for example a liquid quenching medium (e.g., water), to a certain range may provide improved distortion properties while also providing high strength values. However, adjusting both the SHT temperature and the quench medium temperature may require additional modifications to the SHT and AA temperatures and/or times in order to achieve mechanical properties similar to those of previous heat treatments (e.g., YS of at least 200 MPa and r/t ratio of less than 0.3).

As described above, it has been discovered that a lower solution heat treatment temperature may reduce or minimize distortion (other parameters being constant). In at least one embodiment, the SHT may be performed at a temperature between the solvus temperature and 540° C., or any sub-range therein. In one embodiment, the SHT temperature may be between 500° C. and 535° C. In another embodiment, the SHT temperature may be between 505° C. and 530° C. In another embodiment, the SHT temperature may be between 508° C. and 530° C. Non-limiting examples of SHT temperatures may include about 508° C., about 519° C., or about 530° C. Maintaining furnaces at exact temperature can be difficult, therefore the term "about" may include a tolerance of ±5° C. In one embodiment, the SHT may be performed at a constant or substantially constant temperature within the above ranges (e.g., ±5° C.). The SHT time may vary depending on the SHT temperature. In general, a higher SHT temperature may allow for a shorter SHT time, and vice versa. In at least one embodiment, the SHT time may be from 0.5 to 5 hours, or any sub-range therein. For example, the SHT time may be from 1 to 5 hours, 2 to 5 hours, 1 to 4 hours, or 2 to 4 hours. Non-limiting examples of SHT times may include about 2, 3, or 4 hours, with "about" generally meaning ±15 minutes. It has been found that the above SHT temperatures and times may allow for high-strength, bendable, and low-distortion components, when combined with the quench medium and artificial aging process described below.

It has been discovered that a liquid quench medium, such as water, having a temperature within a certain range may allow for high strength and bendability of a 6XXX series Al-alloy component, while reducing distortion (particularly for complex parts). In at least one embodiment, the liquid quench medium may have a temperature from 75° C. to 95° C., or any sub-range therein. For example, the liquid quench medium may have a temperature from 80° C. to 90° C. or 82° C. to 88° C. In one embodiment, the liquid quench medium may have a temperature of about 85° C., wherein "about" may be ±3° C. Typical liquid quench medium temperatures are around room temperature (e.g., 20° C. to 26° C.), or slightly higher (e.g., up to about 55° C.). Lower quench temperatures result in faster cooling rates, which generally result in higher yield strengths. Room temperature quench medium is also easier and more cost effective to maintain. Therefore, low quench temperatures are typically favored. However, a particular liquid medium temperature range has been discovered that still provides high strength and bendability after artificial aging (e.g., ≥200 MPa), while also reducing the amount of distortion that occurs in the components from the AA heat treatment. In one embodiment, the quench rate may be maintained at around 80 to 100° C./s. For example, the quench rate may be maintained at 80 to 90° C./s or at about 85° C./s (e.g., ±5° C./s). The quench rate may be maintained during at least a portion of the cooling process, such as from when the component is about 475° C. to about 290° C. In order to achieve the high strength and bendability using the elevated liquid quench medium temperature, the SHT and AA temperature and time parameters may have to be adjusted from conventional parameters and may need to be within certain particular ranges, similar to the quench medium temperature.

In at least one embodiment, the artificial aging temperature may be between 200° C. and 250° C., or any sub-range therein. For example, the AA temperature may be between 200° C. and 245° C., 215° C. and 245° C., 225° C. and 245° C., or 230° C. and 245° C. Non-limiting examples of AA temperatures may include about 200° C., about 215° C., about 230° C. or about 245° C. Maintaining furnaces at exact temperature can be difficult, therefore the term "about" may include a tolerance of ±5° C. In one embodiment, the AA process may be performed at a constant or substantially constant temperature within the above ranges (e.g., ±5° C.). In general, lower AA temperatures with respect to lower SHT temperature, may result in a higher yield strength but may also result in lower bendability. The AA time may vary depending on the AA temperature, and may generally be shorter for higher temperatures (and vice versa). In at least one embodiment, the AA time may be from 0.5 to 10 hours, or any sub-range therein. For example, the AA time may be from 1 to 9 hours or 2 to 8 hours. Non-limiting examples of AA times may include about 2, 3, 4, 5, 6, 7, or 8 hours, wherein "about" may mean±15 minutes.

In at least one embodiment, the components heat treated and processed according to the disclosed methods may be sheet metal components. Sheet metal components may have a thickness of 0.5 to 5 mm, or any sub-range therein, such as 0.8 to 4 mm, 1 to 3.5 mm, or others Sheet metal may come in large sheets, which may be wrapped on a coil and unrolled to be cut and shaped. In embodiments where a stack of sheets is formed and joined, for example using self-piercing rivets, there may be 2 or more sheets, such as 2 to 10 sheets or any sub-range therein (e.g., 2, 3, 4, 5, or more sheets). The total stack thickness may have a total thickness of up to 4, 6, 8, 10, or 12 mm. The processing may include a shaping process prior to the heat treatment steps. The shaping process may include a stamping process, in which the component may be punched and/or shaped. In one embodiment, the shaping process may include progressive stamping using a progressive stamping die. Progressive stamping generally includes multiple sheet metal stamping operations using more than one die or die station. Progressive stamping allows for complex components to be formed, such as those having multiple, non-coplanar mating surfaces. The process is also applicable to unshaped components, such as sheet metal from a coil. In addition, the process may begin with a component that has already been previously shaped, for example, using progressive stamping or other shaping processes. The heat treatment of sheet metal may differ from that of castings. For example, castings are not influenced by quench rate to the same extent as sheet metal stampings, due to the higher surface to volume ratio of sheet metal. Therefore, castings typically require a greater soak time for homogenization. In addition, castings tend to solutionize at higher temperatures, for example approximately +30° higher than sheet materials.

With reference to FIG. 11, a table is shown including 18 runs of 6061 aluminum alloy coupons that received various SHT and AA treatments with an elevated quench temperature. SHT temperatures of 508° C., 519° C., and 530° C. were tested with a common SHT time of 4 hours. The quench temperature was a constant 88° C. for each run and the quench medium was liquid water. AA temperatures of 200° C., 215° C., 230° C., and 245° C. were tested, with the AA time varying between 2, 4, 6, and 8 hours. The average yield strength was tested for each run, as well as the bendability ratio to see if it met an r/t ratio target of less than 0.3 (15 samples per run, 5 for YS and 10 for bendability).

As shown in the table, all of the runs resulted in an average yield strength of at least 200 MPa. This is in stark contrast to the samples measured with reference to FIG. 10, which had an average yield strength of 124 MPa, despite the same elevated quench temperature. Accordingly, the data shows that high yield strengths may be achieved, even at an elevated quench temperature, when certain combinations of SHT temperature/time and AA temperature/time are used. The runs at the lowest AA temperature in each set of SHT temperatures (e.g., runs 1-2, 7-8, and 13-14) had substantially higher yield strengths than others in the same set, but did not meet the r/t<0.3 target. Accordingly, even within the ranges discovered to provide high strength and low distortion, some combinations may not provide all of the desired properties. This further shows that there is a complex relationship between the SHT temperature/time, the quench temperature, and the AA temperature/time and that changes to one parameter can have a large impact on the end properties.

Figures 12, 13:
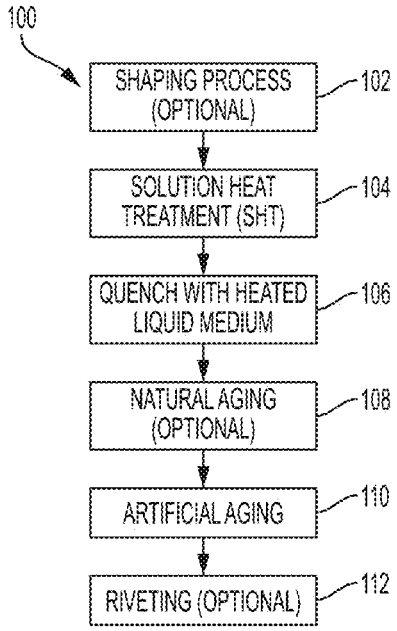
FIG. 12 is a table of solution heat treatment parameters, including quench temperature, and resulting properties for a plurality of components.
FIG. 13 is a flowchart of a method of forming or processing an air-quenchable aluminum alloy, according to an embodiment.

For comparison, FIG. 12 shows a table of experimental data from 10 runs of 6061 aluminum alloy components that received a T7 heat treatment at various SHT temperatures and quench temperatures. The data includes average yield strength, bendability, and Percent Inspection Points That Satisfy Tolerance (PIST) difference values. As shown, it is very difficult to achieve satisfactory values for all three properties (e.g., ≥200 MPa yield strength, r/t<0.3, and low or zero PIST difference).

With reference to FIG. 13, a method or process 100 is shown for forming an aluminum alloy component having high strength, good bendability, and low distortion, such as a T7 temper. At step 102, an optional shaping process may be performed. The shaping process may include a stamping process, in which the component may be punched and/or shaped. In one embodiment, the shaping process may include progressive stamping using a progressive stamping die (described above). While process 100 is shown including the shaping step 102, the process is also applicable to unshaped components, such as sheet metal from a coil. In addition, the process 100 may begin with a component that has already been previously shaped, for example, using progressive stamping or other shaping processes.

At step 104, a solution heat treatment (SHT) is performed on an aluminum alloy component, such as a 6XXX series age-hardenable aluminum alloy component (e.g., 6061 or 6111). The component may have been shaped in step 102 or may be an as-received component. The alloy may have any of the basic temper designations described above, for example an O- temper (annealed) or an F- temper (as-fabricated). In at least one embodiment, the SHT may be performed at a temperature between the solvus temperature and 540° C., or any sub-range therein. In one embodiment, the SHT temperature may be between 500° C. and 535° C. In another embodiment, the SHT temperature may be between 505° C. and 530° C. In another embodiment, the SHT temperature may be between 508° C. and 530° C. In another embodiment, the SHT temperature may be between 505° C. and 515° C. Non-limiting examples of SHT temperatures may include about 508° C., about 519° C., or about 530° C. (about may be ±3° C.). The SHT temperature is dependent on each alloy's solvus temperature. A solution heat treatment temperature significantly above the solvus temperature may result in incipient melting. A SHT temperature significantly below solvus temperature may result in insufficient dissolution of the solute elements. Both conditions may be detrimental to the mechanical properties of heat treatable aluminum alloys. In addition, relatively high SHT temperatures may lead to increased distortion in a finished part after an artificial aging heat treatment. The SHT time may vary depending on the SHT temperature. In general, a higher SHT temperature may allow for a shorter SHT time, and vice versa. In at least one embodiment, the SHT time may be from 0.5 to 5 hours, or any sub-range therein. For example, the SHT time may be from 1 to 5 hours, 2 to 5 hours, 1 to 4 hours, or 2 to 4 hours. Non-limiting examples of SHT times may include about 2, 3, 3.5, or 4 hours. The SHT may be performed using any suitable heating equipment, such as an oven or furnace, which may be stationary or continuous.

At step 106, a quenching process is performed following the SHT. The time gap between the end of the SHT and the beginning of the quenching process may be referred to as the quench delay. In at least one embodiment, the quench delay may be 30 seconds or less, for example, up to 20 seconds or up to 15 seconds. The quenching process may include liquid quenching, in which the component is exposed to a liquid medium (e.g., water or oil) that has a temperature lower than the component. The liquid may be heated (e.g., above ambient temperature). In at least one embodiment, the liquid quench medium may have a temperature from 75° C. to 95° C., or any sub-range therein. For example, the liquid quench medium may have a temperature from 80° C. to 90° C. or 82° C. to 88° C. In one embodiment, the liquid quench medium may have a temperature of about 85° C., wherein "about" may be ±3° C. In one embodiment, the liquid medium may be water.

It has been discovered that for 6XXX series aluminum alloys, a certain threshold of yield strength, bendability (an indication of toughness), and reduced distortion may be attained by liquid quenching within a certain range quenching temperature. In at least one embodiment, a 6XXX series component having a yield strength of at least 200 MPa and a bendability of r/t≤0.3, as well as low distortion (e.g., less than ±1.0, 0.7, or 0.5 mm) may be achieved using an elevated temperature liquid quench. These properties may allow the components to be used as structural components in certain applications, such as vehicles (e.g., Al-intensive trucks). Quenching temperatures that are outside of these ranges may produce components that are 1) strong, but not tough; 2) tough, but weak; or 3) strong and tough, but too distorted.

In at least one embodiment, the component(s) may be quenched throughout the entire cooling temperature range using the elevated temperature liquid medium, such as from the SHT temperature to the natural aging temperature or the start of the artificial aging temperature. The process 100 may include only liquid quenching and no other type of quenching, such as air. In one embodiment, the quench step 106 may include quenching at the temperatures described above over at least a certain temperature range, such as from the temperature of the component after the SHT (and any quench delay) to a lower threshold temperature at which the quenching process is substantially complete. For example, the quench using heated water may be performed from at least when the components are at about 475° C. (e.g., after SHT and any quench delay) until they are about 290° C. Once the component(s) have reached a certain temperature, such as about 290° C., they may continue to be quenched, but at a lower rate (e.g., using air or different liquid temperature/medium).

At step 108, the component may be naturally aged. Natural aging generally includes letting a component rest at, or close to, room temperature for a certain period of time. After a quench, natural aging may cause precipitation hardening to begin, although at a very slow pace. In the context of large-batch or continuous manufacturing, natural aging may occur as a result of production schedules and different batch sizes for different processes. For example, the SHT and quench process may have smaller batch sizes than a subsequent artificial aging process. Therefore, the first few batches of components that are solution heat treated may be set aside until the remaining batches are finished, such that they can all be artificially aged in one large batch. While the batches are waiting to be artificially aged, they are naturally aging. Since some components may wait longer than others before the artificial aging, the amount of natural aging for each component may vary according to which batch it is in, the size of the batches, or other factors. In at least one embodiment, the component(s) may be naturally aged for up to 24 hours. However, some components may naturally age for less time, such as 4, 8, 12, 16, or 20 hours, and some components may not be naturally aged at all (e.g., a final batch may by artificially aged directly after a SHT and quench). Naturally aging for longer than 24 hours is also possible, however, such relatively long aging processes may not be conducive to high-volume manufacturing processes or those where high levels of consistency between batches is very important.

At step 110, the component is artificially aged in order to precipitation harden the component. As described above, the standard age hardening heat treatment to achieve a T6 temper in a 6XXX alloy may be at a temperature of about 160° C. to 180° C. for 8 to 18 hours. However, the standard heat treatment is based on an alloy that is conventionally quenched (e.g., using a low temperature liquid quench). It has been discovered that a significantly shorter artificial aging heat treatment may be used to produce a liquid-quenched, high strength, high bendability, low distortion 6XXX series aluminum alloy. In at least one embodiment, the artificial aging temperature may be between 200° C. and 250° C., or any sub-range therein. For example, the AA temperature may be between 200° C. and 245° C., 215° C. and 245° C., 220° C. and 245° C., 220° C. and 235° C., 220° C. and 230° C. Non-limiting examples of AA temperatures may include about 200° C., about 215° C., about 220° C., about 225° C., about 230° C. or about 245° C. ("about" may be ±3° C.). The AA time may vary depending on the AA temperature, and may generally be shorter for higher temperatures (and vice versa). In at least one embodiment, the AA time may be from 0.5 to 10 hours, or any sub-range therein. For example, the AA time may be from 1 to 9 hours or 2 to 8 hours. Non-limiting examples of AA times may include about 2, 3, 4, 5, 5.5, 6, 7, or 8 hours.

The AA process may produce components having a yield strength of at least 200 MPa, for example, at least 210 MPa or at least 220 MPa. However, in addition to having increased yield strength, the components may also have good bendability and toughness, as evidenced by low r/t ratios. In one embodiment, the components may have an r/t ratio of less than 0.4, for example, 0.3 or less or 0.27 or less. Components produced using the process 100 may therefore have yield strengths of at least 200 MPa and r/t ratios of 0.3 or less, while also having low levels of distortion. Distortion tolerances for components may vary depending on the application, but in at least one embodiment, a distortion tolerance for a component at one or more locations (e.g., a mating surface) may be no more than ±1.5 mm, for example, less than or equal to ±1.0 mm.±0.7 mm or ±0.5 mm. Components manufactured using the disclosed processes may include a plurality of testing locations (e.g., mating surfaces) that are each within the distortion tolerance. These properties make the components suitable for a wide range of applications, including some in which 6XXX series aluminum alloys were previously unable to be used. For example, the components may be used as structural components in vehicles (e.g., aluminum intensive cars and trucks). These components may be formed of thick gauge (e.g., 2-4 mm) aluminum sheet and may have complex shapes, such as those having multiple, non-coplanar mating surfaces.

In step 112, the component may be joined to another component, such as by riveting. In one embodiment, the component may be joined by one or more self-piercing rivets (SPRs). The component may be a sheet or stack of sheets, such as stack 10, or may be a shaped component, such as components 20 and 30. The component being joined to the heat treated component of process 100 may be a sheet, stack of sheet, or shaped component, and may have undergone a similar/same process 100 or a different (or no) process.

With reference to FIG. 14, pre and post heat-treatment measurements are shown for samples treated according to the disclosed modified T7 heat treatment, with clear cells representing an in-specification measurement and shaded cells representing an out-of-specification measurement. The y-axis represents 22 test samples and the x-axis represents ten different test locations on each test sample. The +/− units are in mm from the specified location (e.g., −0.5 is 0.5 mm less than the specification). The modified T7 heat treatment performed for these samples included a solution heat treatment (SHT) of about 508° C. for 3.5 hours and quenching using liquid water at about 88° C. The artificial aging process included a temperature of 220° C. for 5.5 hours. The resulting components had an average yield strength of 226 MPa (std. deviation of 2 MPa) and a bendability ratio (r/t ratio) of less than 0.30, which are generally sufficient for many structural applications in which joinability (e.g., rivetability) are also important. As shown in FIG. 14, only a single location for a single part was outside of tolerance (part 13, first column) after the heat treatments, for a PIST of 99.55%. This data confirms that Applicant has discovered a relatively narrow set of SHT, quench, and AA temperatures and times that provide a combination of high strength (e.g., at least 200 MPa), good bendability (e.g., r/t<0.3), and low or minimal distortion (e.g., PIST of at least 95, 98, 99, or 99.5 percent).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of processing an aluminum alloy component, comprising:

solution heat treating the component at a temperature of 500° C. to 535° C.;

quenching the component in a first medium at a first rate to approximately 290° C.;

subsequently quenching the component in a second medium at a second rate less than the first rate; and artificially aging the component at a temperature of 200° C. to 250° C. to a yield strength of at least 200 MPa.

2. The method of claim 1, wherein the component is a 6XXX series aluminum alloy comprising 0.4 to 0.7 wt. % silicon and 0.7 to 1.2 wt. % magnesium.

3. The method of claim 1, wherein the artificially aging step includes artificially aging the component to an r/t ratio of less than 0.3.

4. The method of claim 1, wherein the solution heat treatment temperature is from 505° C. to 530° C.

5. The method of claim 1, wherein the solution heat treating step includes heat treating the component for 2 to 4 hours.

6. The method of claim 1, wherein the first medium has a temperature of 75° C. to 95° C.

7. The method of claim 1, wherein the first medium has a temperature of 82° C. to 88° C.

8. The method of claim 1, wherein the artificially aging step includes heat treating the component for 3 hours.

9. The method of claim 1, further comprising joining the aluminum alloy component to a second component with a self-piercing rivet.

10. A method of processing an aluminum alloy component, comprising:

solution heat treating the component at a temperature of 505° C. to 530° C. for 2 to 4 hours;

in response to the component cooling to a temperature of 475° C. during a quenching delay, quenching the component in a liquid quenching medium having a temperature of 75° C. to 95° C.; and artificially aging the component for 2 to 4 hours to a yield strength of at least 200 MPa.

11. The method of claim 10, wherein the artificial aging step includes heat treating the component at an artificial aging (AA) temperature of 200° C. to 250° C. for 3 hours.

12. The method of claim 10, wherein the artificially aging step includes artificially aging the component to an r/t ratio of less than 0.3.

13. A method of forming a structural vehicle component, comprising:

stamping a sheet of an 6XXX series aluminum alloy;

solution heat treating the component;

quenching the component in a liquid quenching medium at a rate of 80° C./s to 100° C./s;

subsequently quenching the component in an air quenching medium at a rate less than 80° C./s; and artificially aging the component for 2 to 4 hours to a yield strength of at least 200 MPa.

14. The method of claim 13, wherein the solution heat treating step includes heat treating the component at a solution heat treatment (SHT) temperature of 505° C. to 530° C. for 2 to 4 hours and the artificial aging step includes heat treating the component at an artificial aging (AA) temperature of 200° C. to 250° C. for 3 hours.

15. The method of claim 13, wherein the liquid quenching medium is water and has a temperature of 82° C. to 88° C.

16. The method of claim 13, further comprising joining the stamped 6XXX series aluminum alloy component to a second component with a self-piercing rivet.

17. The method of claim 1, wherein the first medium is a liquid, and wherein the second medium is air.

18. The method of claim 1, wherein the first medium is a first liquid, and wherein the second medium is second liquid different than the first liquid.

19. The method of claim 1, further comprising delaying quenching the component in the first medium until the component has cooled to a temperature of approximately 475° C.

20. The method of claim 1, wherein the first rate is approximately 80° C./s to 100° C./s, and wherein the second rate is less than 80° C/s.

* * * * *